US005503417A

United States Patent [19]

Murphy

[11] Patent Number: 5,503,417

[45] Date of Patent: Apr. 2, 1996

[54] ERECTABLE DISPLAY ASSEMBLY WITH CASTERS

[76] Inventor: Thomas V. Murphy, 51 Fox Hedge Rd., Saddle River, N.J. 07458

[21] Appl. No.: 404,203

[22] Filed: Feb. 13, 1995

Related U.S. Application Data

[63] Continuation-in-part of Ser. No. 29,545, Oct. 7, 1994.

[51] Int. Cl.[6] ..... B62B 3/02; B65D 90/18

[52] U.S. Cl. ..... 280/79.11; 280/639; 280/79.2; 16/30; 229/117.03

[58] Field of Search ..... 280/79.11, 79.2, 280/639, 87.05, 79.7, 42, 37, 47.34; 16/29, 30; 220/4.29, 6; 229/117.02, 117.03, 120.23, 120.35, 120.36, 199

[56] References Cited

U.S. PATENT DOCUMENTS

| | | | |
|---|---|---|---|
| 1,108,289 | 8/1914 | Weiss | 229/199 |
| 1,604,723 | 10/1926 | Rutherford | 16/29 |
| 1,736,949 | 11/1929 | Szekely | 280/79.2 |
| 2,049,344 | 7/1936 | Wittke, Jr. | 16/30 |
| 2,564,939 | 8/1951 | Weast | 280/42 |
| 2,716,558 | 8/1955 | Sullivan | 280/79.2 |
| 2,775,393 | 12/1956 | Rugg | 229/117.02 |
| 2,859,905 | 11/1958 | Choate | 229/199 |
| 4,576,391 | 3/1986 | Gerstner | 280/79.11 |
| 4,699,391 | 10/1987 | Syring | 280/79.11 |
| 4,754,916 | 7/1988 | Knight, Jr. | 229/120.23 |
| 5,356,031 | 10/1994 | Jondelius | 280/79.2 |

*Primary Examiner*—Margaret A. Focarino
*Assistant Examiner*—Carla Mattix
*Attorney, Agent, or Firm*—Schweitzer Cornman & Gross

[57] ABSTRACT

A merchandise display apparatus is disclosed, which comprises a foldable/erectable tubular structure formed of a series of foldably connected wall panels. When erected, the tubular support has at least three sides, at least one of which has an intermediate hinge line to accommodate a bellows fold. A plurality of caster assemblies is provided, one for each corner of the polygonal configuration formed by the erected tubular support. The caster assemblies include rigid channel-forming flanges, arranged at a predetermined angle corresponding to the corner angles of the erected polygon. When the foldable polygon is erected, the caster assemblies are applied over the lower end portions, at each corner, providing mobile support for the structure and simultaneously rigidly securing the otherwise foldable wall panels in the desired, erected cross sectional configuration. A rigid forming panel is inserted into the erected structure and is supported by the caster assemblies. A cross brace, formed by intersecting flat panels, is positioned within the polygon, extending between corners to impart strength and rigidity to the structure. One or more product trays are supported on the panels of the cross brace.

13 Claims, 4 Drawing Sheets

FIG. 5
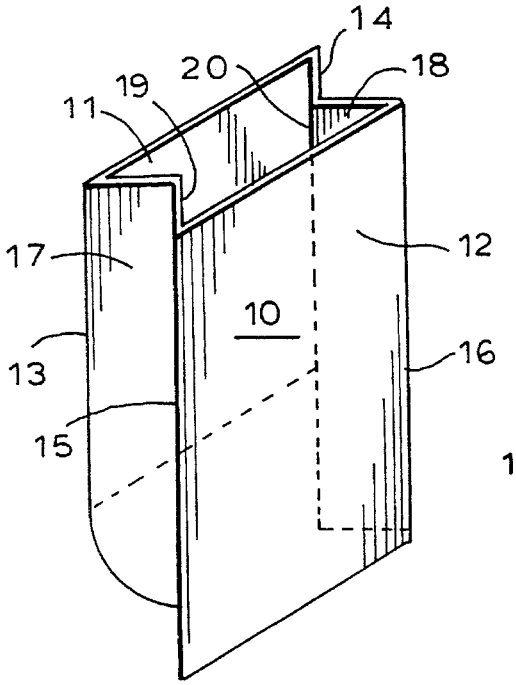
FIG. 6
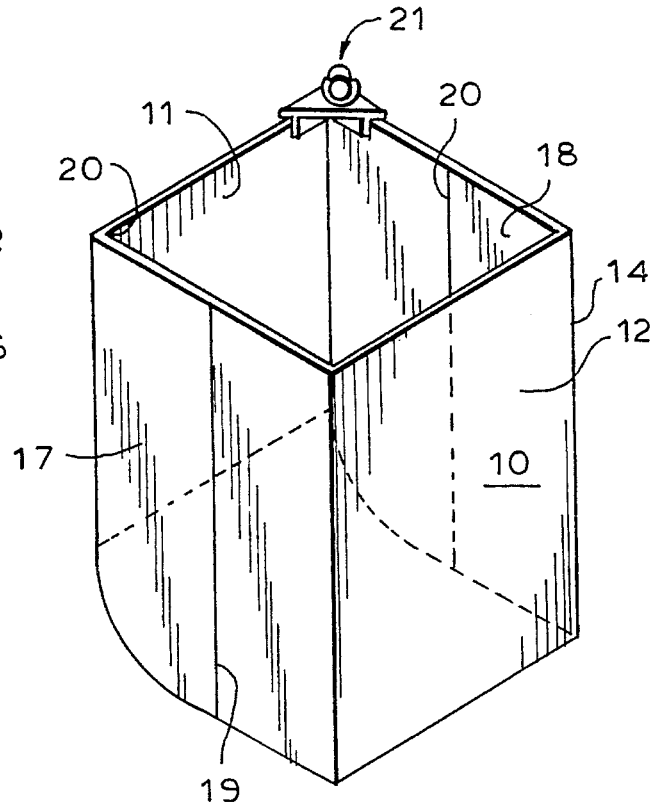
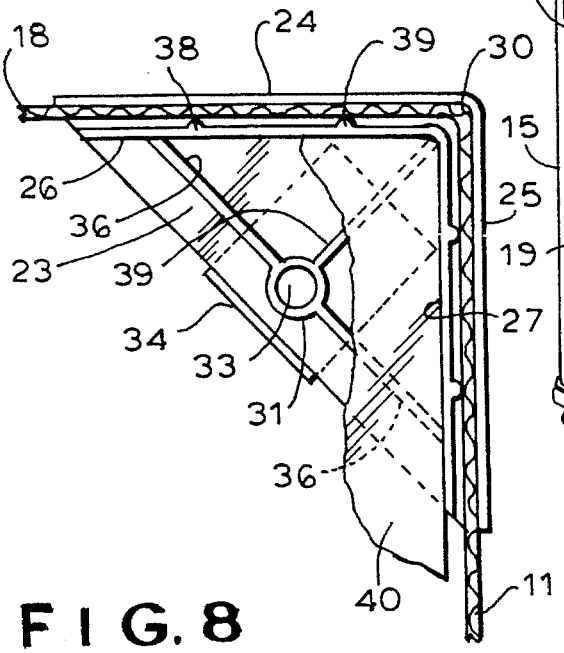
FIG. 8
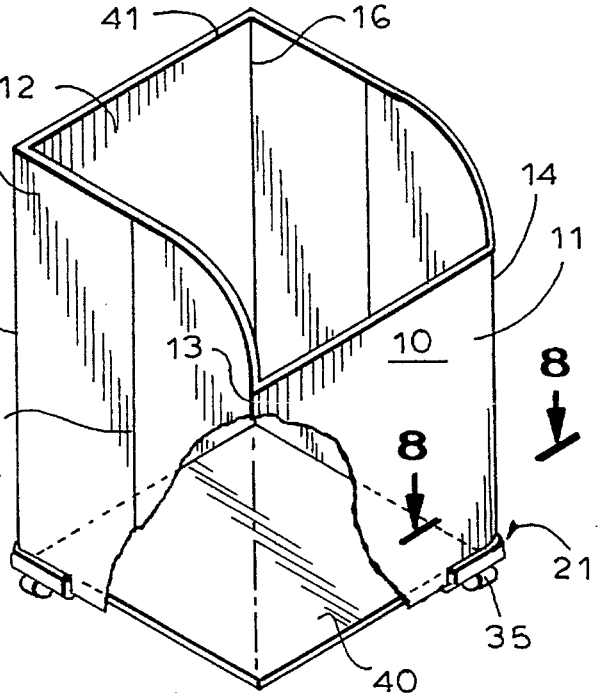
FIG. 7

FIG. 9
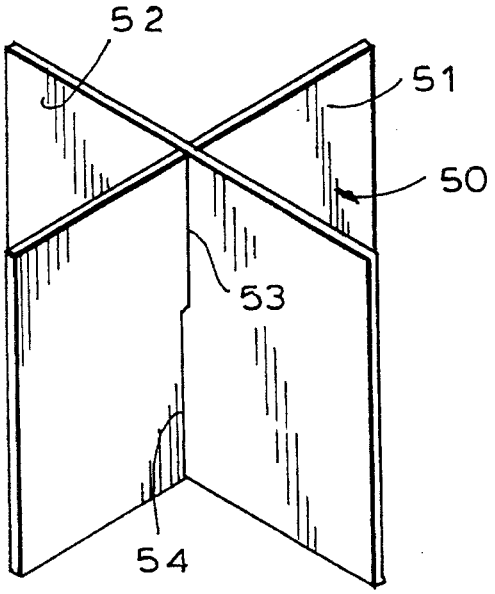
FIG. 10
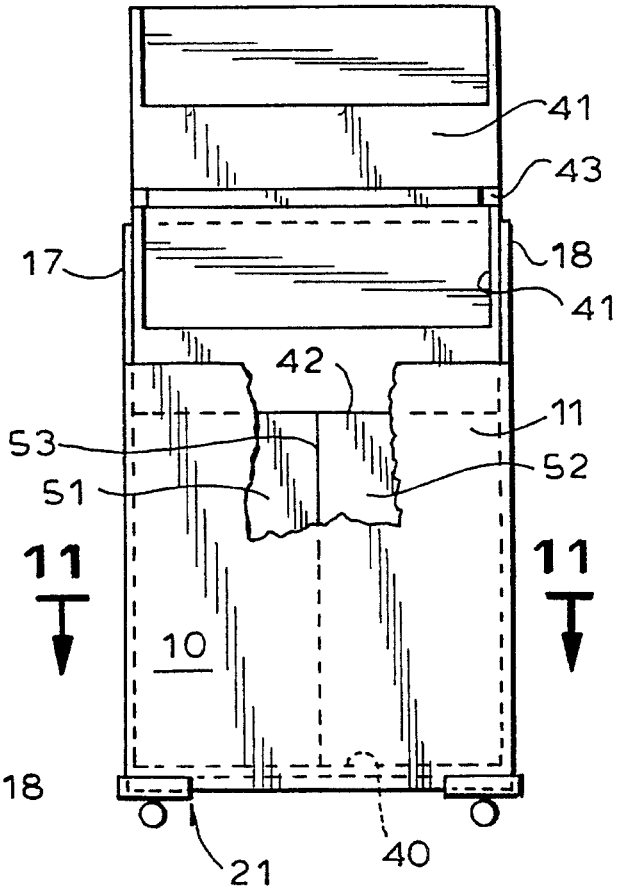
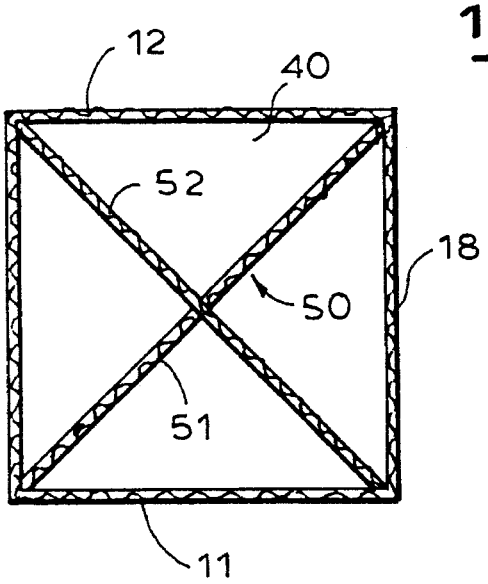
FIG. 11

ERECTABLE DISPLAY ASSEMBLY WITH CASTERS

RELATED APPLICATION

This application is a continuation-in-part of copending Design application Ser. No. 029,545, filed Oct. 7, 1994.

BACKGROUND AND SUMMARY OF THE INVENTION

In the merchandising of relatively small packaged products in retail environments, it frequently is desirable to provide in-aisle product displays, presenting the product in a highly visible and very convenient manner to encourage impulse purchases. There are many known devices for this purpose, among which are reflected in the Thomas V. Murphy U.S. Pat. Nos. 4,377,231 and 4,121,710. Many of these in-aisle displays are designed to be shipped in collapsed or folded form and to be erected at the retail site. In some cases, inexpensive, in-aisle display units may be designed to be shipped along with a special promotional shipment of merchandise. In some cases, the display device is erected at the retail location. In other cases, the display units may be shipped in erected and pre-loaded form with the casters optionally installed. The units can be employed for in-aisle display during a promotional period, after which it can be stored or, in some cases, discarded.

The present invention is directed to an improved, simplified and highly economical erectable display assembly which can be very inexpensively manufactured and shipped to the site of use in a collapsed or erected condition as desired. The principal elements of the display assembly are a foldable tubular support structure comprised of a plurality of hingedly connected wall panels of relatively stiff material, such as corrugated board. The wall panels are joined along their side edges and form an erectable closed polygon having at least three walls and at least four panels. In a typical case, the support structure may comprise four connected panels, which can be erected to rectangular cross sectional configuration.

In combination with the erectable tubular support is a plurality of caster assemblies, one for each corner of the polygonal support. The caster assemblies are of a novel and advantageous design, provided with mounting bases having upwardly opening rigid Channels to receive lower edge portions of the flat panels. The caster assemblies, which include swivel-mounted caster wheels, are installed at the corners of the erected tubular support structure, and serve to retain a pair of hingedly connected wall panels in a predetermined, desired angular relationship. Thus, after mounting of the several caster assemblies to the corners of the erected polygonal support structure, that structure is rigidified in the desired polygonal cross section, suitable for use in the support of a merchandise display.

To advantage, a forming panel, having the configuration of the desired polygonal cross section, is inserted into the bottom of the erected tubular support, to provide additional strength and rigidity. In addition, a foldable internal cross brace structure is advantageously inserted within the support, with vertical panels of interlocking configuration extending diagonally between opposed corners of the support. The internal cross brace structure, which is supported on the forming panel, serves additionally as a load support for product bins or the like, transferring most of the weight load of displayed product directly to the caster assemblies at the bottom of the tubular support structure.

The display assembly may be shipped in folded form, and erected at the retail site, or it may be erected, and possibly even loaded with product, at the manufacturer's place of business. The assembled and loaded unit is readily movable from place to place at the retail site, and thus ideally suited for its intended application. When desired, the display units can be easily disassembled and folded for storage after use.

For a more complete understanding of the above and other features and advantages of the invention, reference should be made to the followed detailed description of a preferred embodiment of the invention.

DESCRIPTION OF THE DRAWINGS

FIG. 5 is a perspective view of a foldable tubular support structure utilized in combination with the caster assembly of FIG. 1 to form a rigid support according to the invention.

FIG. 6 is a perspective view of the tubular support structure of FIG. 5, in a fully erected configuration, illustrating a caster assembly installed at one corner.

FIG. 7 is a perspective view of the tubular support structure of FIGS. 5 and 6, reoriented to its normal position, with caster assemblies installed at all corners and a bottom forming panel in position.

FIG. 8 is an enlarged fragmentary cross sectional view as taken generally on line 8—8 of FIG. 7, with parts broken away.

FIG. 9 is a perspective illustration of a foldable internal cross brace advantageously utilized in the support structure of FIG. 7.

FIG. 10 is a front elevational view, with parts broken away, showing a fully assembled display unit according to the invention, with installed cross brace member and product bins.

FIG. 11 is a cross sectional view as taken generally on line 11—11 of FIG. 10.

DESCRIPTION OF PREFERRED EMBODIMENTS

Figure 1:
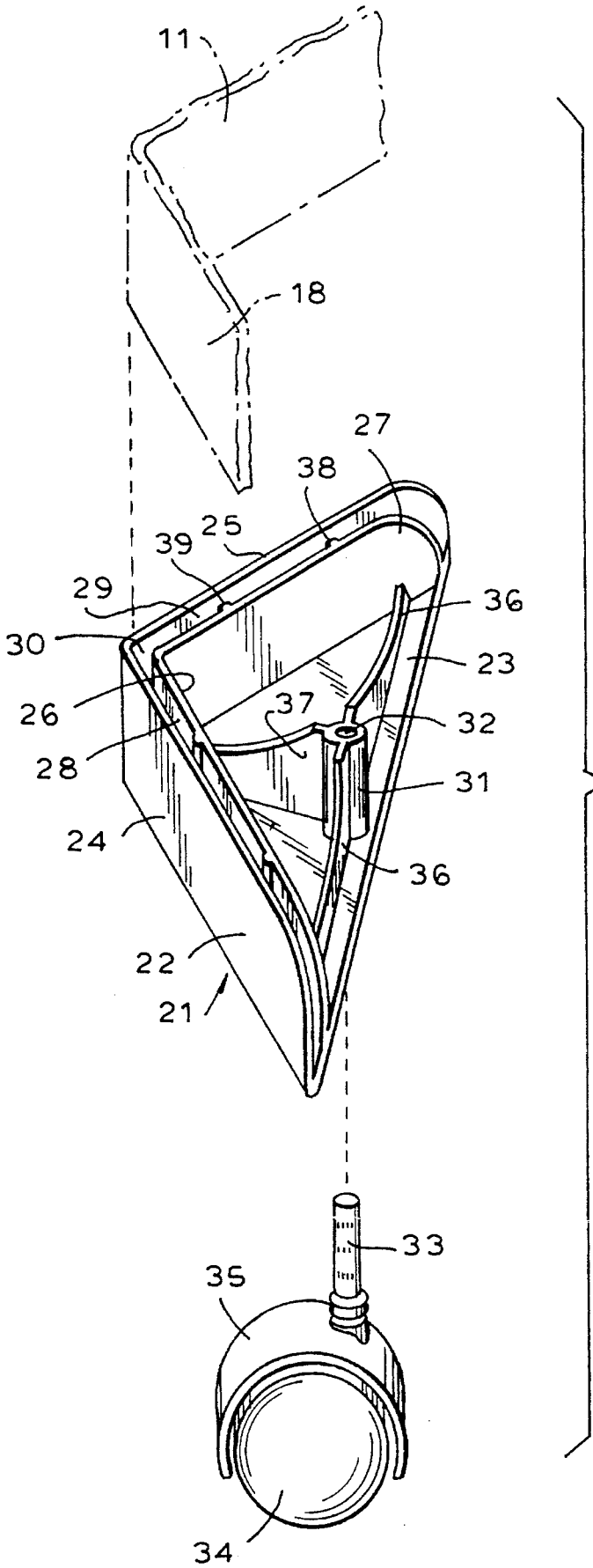
FIG. 1 is an exploded view of a caster assembly, illustrating the manner of its assembly with a foldable tubular support structure according to the invention.

Referring now to the drawings, the reference numeral 10 (FIG. 5) illustrates generally a foldable tubular support structure comprised of a plurality of relatively rigid panels, hingedly joined at their side edges. In the illustrated arrangement, there are a pair of opposed flat panels 11, 12, joined along their opposite side edges 13, 14 and 15, 16 respectively to a pair of bellows panels 17, 18. The bellows panels are each comprised of a pair of rigid panel sections joined along a vertical center fold line 19, 20, enabling the structure of rigid panels to be collapsed and flat-folded for convenient shipping and handling.

In the illustrated arrangement, the four panels 11, 12 and 17, 18 are of approximately equal size, such that the tubular support structure 10, when erected by outfolding of the foldable bellows panels 17, 18, is of a substantially square cross section, as reflected in FIGS. 6 and 7.

Within the concepts of the invention, the tubular structure may be of any polygonal cross sectional configuration having at least three sides and being comprised of at least four panel sections, so as to be foldable to flat form for shipping and handling and erectable on site to an open, stable tubular cross sectional configuration. Preferentially, all sides of the erected polygonal cross section should have the same width, enabling all of the corners to be configured at the same corner angle, so that all of the caster assemblies may be of identical construction. Within the broader principles of the invention, however, the polygonal cross sectional configuration of the erected tubular support structure could be formed with different corner angles, provided that the caster assemblies supplied with the assembly were configured to corresponding angles.

For the purposes of the present description, all of the corner angles 20 are at 90°, and all of the caster assemblies, generally designated by the reference numeral 21 are configured for installation at right angle corners.

Figure 2:
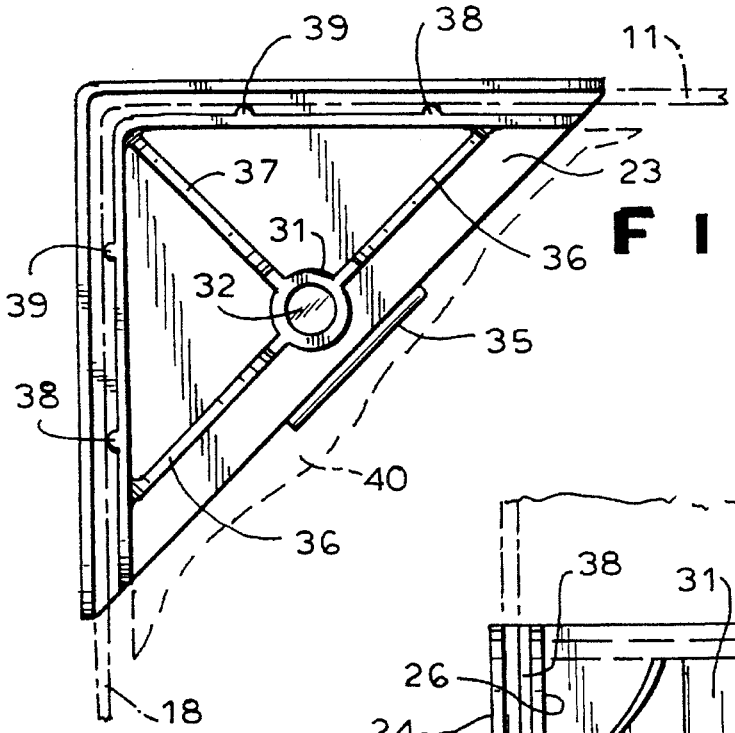
FIGS. 2, 3 and 4 are, respectively, a top plan view, a side elevational view and an elevational view along a 45° diagonal, of the caster assembly of FIG. 1.
Figure 3:
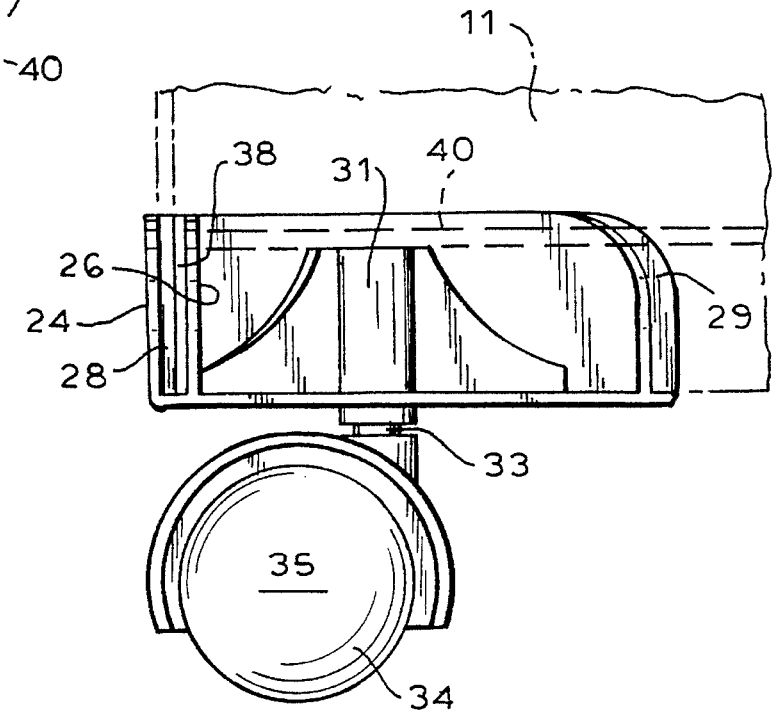
Figure 4:
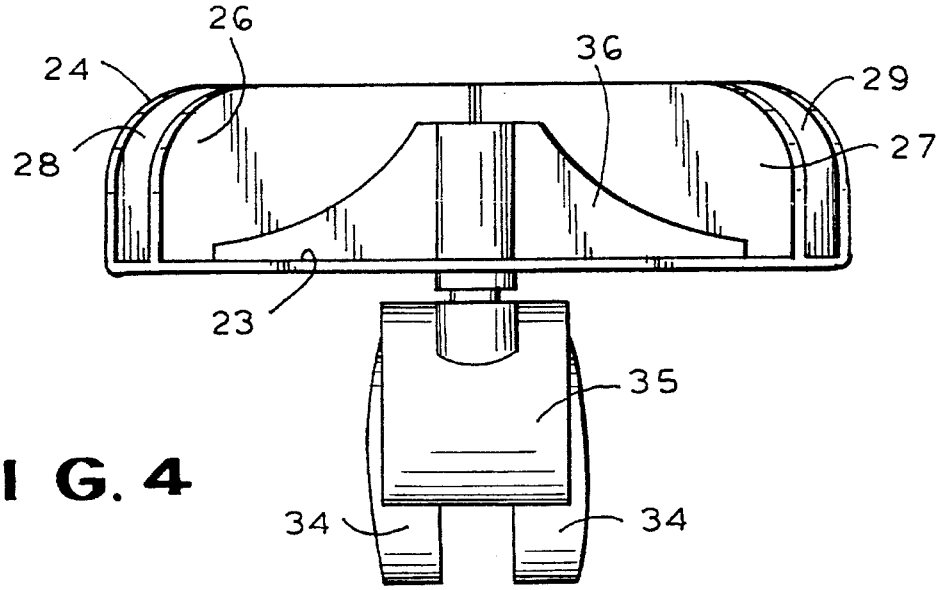

Referring now to FIGS. 2, 4 and 8, the caster assemblies 21 are comprised of a mounting base 22, advantageously a unitary injection molding of structural plastic material. The mounting base includes a flat base panel 23 joined integrally at its outer edges with vertical outer flange walls 24, 25. Although it should be clearly understood that specific dimensions do not form a part of this invention, in a typical commercial embodiment of the invention, the outer flange walls 24, 25 might have a typical length, measured horizontally, of about 3 ½ inches and a typical vertical height of about 1¼ inches.

Spaced a short distance inside the outer flange walls 24, 25 and arranged in parallel relation thereto are inner vertical flange walls 26, 27. The inner flange walls are integral with the base wall 23 and, together with the outer walls 24, 25 form upwardly opening rigidly defined channels 28, 29. In the illustrated arrangement, the respective channels 28, 29 are oriented at right angles and join at a common corner 30.

A tubular socket 31, molded integrally with the base 23, extends upwardly therefrom and is formed with a bore 32 for the snug reception of a stem 33 forming a swivel support for caster wheels 34. The stem 33 and wheels 34 collectively form a caster unit 35, which in all respects may be of conventional construction. Rigid support for the tubular socket 31 is provided by opposed vertical webs 36, integral with the socket 31 and with the base member 23 and extending in opposite directions from the socket 31. A third vertical web 37, also integral with the socket 31 and base 23, extends diagonally from the socket to the corner area of the mounting base.

In the illustrated and preferred form of the invention, the wall panels 11, 12, 17, 18 of the tubular support are formed of vertically fluted corrugated board. This material is preferred because it is both functional and inexpensive. However, it will be readily understood, that the panels may be made of other materials.

The channels 28, 29 of the caster mounting bases are designed to snugly receive the corrugated or other material of which the support structure is formed. To this end, the spacing between the respective inner and outer flange walls may be slightly greater than the thickness of the panel material, but each channel is provided with one or more inwardly projecting, vertically oriented ribs 38, 39 or similar elements dimensioned to have squeezing frictional contact with the wall panel material, so that the mounting bases are frictionally self-retaining on the lower edge portions of the tubular support structure.

In assembling the structure of the invention, the polygonal tubular support structure 10 is first opened to its desired cross sectional configuration, as shown in FIG. 6, with its bottom edge portion facing upwardly. The several caster assemblies 21, corresponding in number to the corners of the polygon, are installed at each corner, with the respective channel portions 28, 29 of the mounting bases being pressed over bottom edge portions of adjacent panels, where they meet at the respective corners. As each caster assembly is installed, the corner on which it is installed is rigidified, and the wall panels joined at such corner are fixed at the angle defined by the channels 28, 29. When all caster assemblies have been installed, the unit is inverted, as shown in FIG. 7.

While the support structure is rigidified in its desired configuration upon installation of the caster assemblies, additional structural support typically is needed or desired. For this purpose, a forming panel 40 is inserted into the open upper end of the support structure (FIG. 7). The forming panel 40 is made of a suitably rigid material and has a configuration generally corresponding to the interior cross sectional configuration of the support structure. The forming panel is lowered into the open tubular support and is engaged and supported near the bottom of the structure by the several caster assemblies 21, located at the respective corners of the structure. The forming panel 40 provides support against inward deflection of any of the side panels 11, 12, 17 or 18, and also provides for transfer of the weight of the displayed product to the caster assemblies, as will appear. In a typical structure, it is sufficient to support the forming panel 40 by gravity alone, allowing it to rest on top of the web section 36, 37 and socket 31.

To advantage, the structure of the invention also includes a cross brace, formed of a pair of rectangular flat panels 51, 52 of corrugated board or other material suitable to form an inexpensive flat panel. Each of the panels 51, 52 is formed with a central vertical slot 53, 54 extending over half its height, so that the two panels can be assembled together in an interlocking configuration. The width of the panels 51, 52 is equal to the diagonal dimensions of the erected support structure 10, being inserted vertically from the open top of the structure and being supported therein by the forming panel 40. As is evident in FIG. 11, the cross brace 50 serves to rigidify the walls of the support structure, in order to maintain the support structure in a vertical column.

In the illustrated form of the invention, the front wall 11 of the support structure is slightly lower in height than the remaining three walls. Desirably, the height of the cross brace 50 is slightly less than the height of the front wall 11, as reflected in FIG. 10.

In typical operation, the display assembly shown in FIG. 7 provides a support structure on which is placed a merchandise display. The particular merchandise display itself forms no part of the invention, but typically comprises one or a plurality of vertically stackable racks or trays 41 filled with the merchandise to be displayed. As shown in FIG. 10, the lowermost tray advantageously is received within the confines of the four walls of the support structure 10, with its bottom wall 42 wall 42 supported by the upper edges of the cross brace 50. Additional trays 41, if utilized, are stacked on top of each other, with conventional stacking elements 43 being provided for this purpose. The weight load of the trays 41 and any products therein is supported directly by the caster assemblies 21, through the panels of the cross brace 50, and the forming panel 40 at the bottom, and is effectively isolated from the sidewalls of the support structure.

The display assembly of the invention is both highly functional for its purpose and very economical to produce and deliver. The erectable tubular support is easily flat folded for shipping and/or later storage, where desired, yet provides a strong durable display support when in operation. By utilizing the caster assemblies in a dual function to at least initially rigidify the otherwise foldable tubular support, the entire structure can be assembled quickly and easily with a minimum number of inexpensive components. The resulting structure is nevertheless rigid and durable and highly suitable for the purpose intended.

Although the display assembly can be manufactured from lightweight inexpensive corrugated board or similar components, the erected structure is both strong and durable. The internal structure allows the weight of the displayed products to be supported directly by the rigid caster assemblies, with minimum stress upon the surrounding support structure. The internal structural arrangement also makes it feasible to erect and load displays at the merchandiser's factory, where desired, so that the display can be shipped to the retailer fully loaded and ready to be placed upon the display floor.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A collapsible-erectable display assembly, which comprises (a) a foldable tubular support structure comprising a plurality of connected wall panels of relatively stiff material, (b) said wall panels having vertical side edges and being hingedly joined along said side edges to form an erectable closed polygon having at least three walls, formed of at least four panels, and at least three corners forming corner angles, (c) said support structure being erectable from a flat-folded configuration to an open, polygonal configuration with top and bottom edge portions, (d) a plurality of caster assemblies removably engageable with said tubular support structure for movably supporting said structure, (e) each of said caster assemblies comprising a rigid mounting base, a rotatable caster wheel, and swivel support means carried by said mounting base for mounting said caster wheel, (f) said mounting base of each said caster assembly including first and second upwardly opening rigid channel-forming portions disposed at a predetermined fixed angle corresponding to the corner angles of the erected polygon, (g) said channel-forming portions defining channels engageable with lower edge portions of a pair of adjacent wall panels and serving to retain said adjacent wall panels at said predetermined fixed angle.

2. A display assembly according to claim 1, wherein (a) said assembly includes a flat, rigid forming panel having a cross sectional configuration generally corresponding to the erected polygonal configuration of said support structure, (b) said forming panel being supported adjacent bottom edge portions of said support structure by said plurality of caster assemblies.

3. A display assembly according to claim 2, wherein (a) said erected polygon is of rectangular configuration, (b) a cross brace structure is provided, comprising a pair of separable flat panels slotted and joined along their respective vertical centerlines in an interlocking configuration, and (c) said cross brace panels have a width dimension corresponding to a diagonal dimension of said erected polygon, and being positioned within said tubular support structure and supported by said forming panel.

4. A display assembly according to claim 3, wherein (a) one or more product trays are positioned on top of said cross brace structure and are supported thereby.

5. A display assembly according to claim 4, wherein (a) said cross brace structure has a vertical dimension less than the height of the walls of said tubular support structure above said forming panel, whereby the top of said cross brace structure is below upper edges of the wall panels of said tubular support structure, and (b) at least one of said product trays has a cross sectional configuration to be received within the walls of said tubular support structure.

6. A display assembly according to claim 1, wherein (a) said tubular support structure comprises at least six wall panels erectable into a closed polygon having four walls and being of rectangular configuration, and (b) said predetermined fixed angle is 90°.

7. A display assembly according to claim 6, wherein (a) opposed pairs of said wall panels are joined along vertical fold lines to accommodate bellows folding thereof.

8. A display assembly according to claim 1, wherein (a) at least one pair of said wall panels is joined along a vertical fold line to accommodate bellows folding of said last mentioned wall panels.

9. A display assembly according to claim 1, wherein said rigid mounting bases each include (a) a generally horizontal base panel, and (b) inner and outer vertical flange walls integral with said base panel and extending upwardly therefrom to form said channel-forming portions.

10. A display assembly according to claim 9, wherein (a) certain of said flange walls are formed with gripping elements projecting into said channels to provide gripping engagement with said wall panels.

11. A collapsible-erectable display assembly, which comprises (a) a foldable tubular support structure comprising a plurality of connected wall panels of relatively stiff material, (b) said wall panels having vertical side edges and being hingedly joined along said side edges to form an erectable polygon having at least three walls and at least three corners forming corner angles, (c) said polygon being erectable from a flat-folded configuration to an open, polygonal configuration with top and bottom edge portions, (d) a plurality of caster assemblies removably engageable with said tubular support structure for movably supporting said structure, (e) each of said caster assemblies comprising a rigid mounting base, a rotatable caster wheel, and swivel support means carried by said mounting base for mounting said caster wheel, (f) said mounting base of each said caster assembly including first and second upwardly opening rigid channel-forming portions disposed at a predetermined fixed angle corresponding to the corner angles of the erected polygon, (g) said channel-forming portions defining channels engageable with lower edge portions of a pair of adjacent wall panels and serving to retain said adjacent wall panels at said predetermined fixed angle and to retain said wall panels in an erected, substantially closed polygonal configuration.

12. A display assembly according to claim 11, wherein (a) said polygon has at least four sides, (b) said assembly includes a flat, rigid forming panel having a cross sectional configuration generally corresponding to the erected polygonal configuration of said support structure, and (c) said forming panel is supported adjacent bottom edge portions of said support structure by said plurality of caster assemblies.

13. A display assembly according to claim 12, wherein (a) a cross brace structure is provided, comprising a pair of separable flat panels joined along their respective vertical centerlines in an intersecting and crossing configuration, (b) said cross brace panels having a width dimension corresponding to a diagonal dimension of said erected polygon between opposed corners thereof, and (c) said cross brace panels are positioned within said tubular support structure and supported by said forming panel.

* * * * *